US005562817A

United States Patent [19]

Mon et al.

[11] Patent Number: 5,562,817

[45] Date of Patent: Oct. 8, 1996

[54] REFORMING USING A PT/RE CATALYST

[75] Inventors: Eduardo Mon; William C. Baird, both of Baton Rouge, La.

[73] Assignee: Exxon Research and Engineering Company, Florham Park, N.J.

[21] Appl. No.: 359,963

[22] Filed: Dec. 20, 1994

[51] Int. Cl.[6] ..... C10G 35/06

[52] U.S. Cl. ..... 208/65; 208/138

[58] Field of Search ..... 208/65

[56] References Cited

U.S. PATENT DOCUMENTS

| | | | |
|---|---|---|---|
| 4,613,423 | 9/1986 | Swan et al. | 208/65 |
| 4,722,780 | 2/1988 | Franck et al. | 208/65 |
| 4,764,267 | 8/1988 | Chen et al. | 208/65 |
| 4,950,385 | 8/1990 | Sivasanker et al. | 208/65 |
| 4,975,178 | 12/1990 | Clem et al. | 208/65 |
| 4,985,132 | 1/1991 | Moser et al. | 208/65 |
| 5,190,638 | 3/1993 | Swan, III. et al. | 208/65 |
| 5,190,639 | 3/1993 | Swart et al. | 208/65 |
| 5,221,463 | 6/1993 | Kamienski et al. | 208/65 |
| 5,342,506 | 8/1994 | Baird, Jr. et al. | 208/65 |
| 5,354,451 | 10/1994 | Golstein et al. | 208/65 |
| 5,368,720 | 11/1994 | Dolan et al. | 208/65 |
| 5,417,843 | 5/1995 | Swart et al. | 208/65 |

*Primary Examiner*—Helane Myers
*Attorney, Agent, or Firm*—Henry E. Naylor

[57] ABSTRACT

Catalytic reforming wherein the lead reactor contains a catalsyt comprised of platinum and a relatively low level of Re on an inorganic oxide support. The tail reactor contains a platinum rhenium catalyst wherein the rhenium content is at higher levels.

10 Claims, No Drawings

REFORMING USING A PT/RE CATALYST

FIELD OF THE INVENTION

The present invention relates to catalytic reforming wherein the lead reactor contains a catalsyt comprised of Pt and a relatively low level of Re on an inorganic oxide support. The tail reactor contains a platinum-rhenium catalyst containing higher levels of rhenium.

BACKGROUND OF THE INVENTION

Catalytic reforming is a process for improving the octane quality of naphthas or straight run gasolines. The catalyst is typically multi-functional and contains a metal hydrogenation-dehydrogenation (hydrogen transfer) component, or components, composited with a porous, inorganic oxide support, notably alumina. Noble metal catalysts, notably of the platinum type, are currently employed, reforming being defined as the total effect of the molecular changes, or hydrocarbon reactions, produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins which produces gas, and inevitably coke, the latter being deposited on the catalyst.

Platinum is widely commercially used in the production of reforming catalysts, and platinum-on-alumina catalysts have been commercially employed in refineries for the last few decades. In the last several years, additional metallic components have been added to platinum as promoters to further improve the activity or selectivity, or both, of the basic platinum catalyst, e.g., iridium, rhenium, tin, and the like. Some of the polymetallic catalysts possess superior activity, or selectivity, or both, as contrasted with other catalysts. Platinum-rhenium catalysts by way of example possess admirable selectivity as contrasted with platinum catalysts, selectivity being defined as the ability of the catalyst to produce high yields of $C_5$+ liquid products with concurrent low production of normally gaseous hydrocarbons, i.e., methane and other gaseous hydrocarbons, and coke. Iridium-promoted catalysts, e.g., platinum-iridium, and platinum-iridium-tin (U.S. Pat. No. 4,436,612) catalysts, on the other hand, are known for their high activity, as contrasted e.g., with platinum and platinum-rhenium catalysts, activity being defined as the relative ability of a catalyst to convert a given volume of naphtha per volume of catalyst to high octane reformate.

In a reforming operation, one or a series of reactors, or a series of reaction zones, are employed. Typically, a series of reactors is employed, e.g., three or four reactors, these constituting the heart of the reforming unit. Each reforming reactor is generally provided with a fixed bed, or beds, of the catalyst which receive downflow feed, and each is provided with a preheater or interstage heater, because the reactions which take place are endothermic. A naphtha feed, with hydrogen, or recycle hydrogen gas, is passed through a preheat furnace and reactor and then in sequence through subsequent interstage heaters and reactors of the series. The product from the last reactor is separated into a liquid fraction, and a vaporous effluent. The former is recovered as a $C_5$+ liquid product. The latter is a gas rich in hydrogen, and usually contains small amounts of normally gaseous hydrocarbons, from which hydrogen is separated and recycled to the process to minimize coke production.

The sum-total of the reforming reactions, supra, occurs as a continuum between the first and last reactor of the series, i.e., as the feed enters and passes over the first fixed catalyst bed of the first reactor and exits from the last fixed catalyst bed of the last reactor of the series. The reactions which predominate between the several reactors differ dependent principally upon the nature of the feed, and the temperature employed within the individual reactors. In the initial or lead reactor, which is maintained at a relatively low temperature, it is believed that the primary reaction involves the dehydrogenation of naphthenes to produce aromatics. The isomerization of naphthenes, notably $C_5$ and $C_6$ naphthenes, also occurs to a considerable extent. Most of the other reforming reactions also occur, but only to a lesser, or smaller extent. There is relatively little hydrocracking, and very little olefin or paraffin dehydrocyclization occurring in the first reactor. Within the intermediate reactor zone(s), or reactor(s), the temperature is maintained somewhat higher than in the first, or lead reactor of the series, and it is believed that the primary reactions in the intermediate reactor, or reactors, involve the isomerization of naphthenes and paraffins. Where, e.g., there are two reactors disposed between the first and last reactor of the series, it is believed that the principal reaction involves the isomerization of naphthenes, normal paraffins and isoparaffins. Some dehydrogenation of naphthenes may, and usually does occur, at least within the first of the intermediate reactors. There is usually some hydrocracking, at least more than in the lead reactor of the series, and there is more olefin and paraffin dehydrocyclization. The third reactor of the series, or second intermediate reactor, is generally operated at a somewhat higher temperature than the second reactor of the series. It is believed that the naphthene and paraffin isomerization reactions continue as the primary reaction in this reactor, but there is very little naphthene dehydrogenation. There is a further increase in paraffin dehydrocyclization, and more hydrocracking. In the final reaction zone, or final reactor, which is operated at the highest temperature of the series, it is believed that paraffin dehydrocyclization, particularly the dehydrocyclization of the short chain, notably $C_6$ and $C_7$ paraffins, is the primary reaction. The isomerization reactions continue, and there is more hydrocracking in this reactor than in any one of the other reactors of the series.

The activity of the catalyst gradually declines due to the build-up of coke. Coke formation is believed to result from the deposition of coke precursors such as anthracene, coronene, ovalene, and other condensed ring aromatic molecules on the catalyst, these polymerizing to form coke. During operation, the temperature of the the process is gradually raised to compensate for the activity loss caused by the coke deposition. Eventually, however, economics dictate the necessity of reactivating the catalyst. Consequently, in all processes of this type the catalyst must necessarily be periodically regenerated by burning of the coke at controlled conditions.

Improvements have been made in such processes, and catalysts, to reduce capital investment or improve $C_5$+ liquid yields while improving the octane quality of naphthas and straight run gasolines. New catalysts have been developed, old catalysts have been modified, and process conditions have been altered in attempts to optimize the catalytic contribution of each charge of catalyst relative to a selected performance objective. Nonetheless, while any good commercial reforming catalyst must possess good activity, activity maintenance and selectivity to some degree, no catalyst can possess even one, muchless all of these properties to the ultimate degree. Nonetheless, while catalysts with high activity are very desirable, there still remains a need, and indeed a relatively high demand, for increased selectivity; and even relativley small increases in C5+ liquid yield can represent large credits in commercial reforming operations.

Further, since the advent of blending oxygenates into refinery mogas pools, many catalytic reforming units will be driven towards lower reformate octanes. This will result in lower hydrogen yields. Consequently, a need exists for catalysts which are more selective for hydrogen make.

Although a large number of various reforming catalysts and processing schemes have been developed over the years, there is still a need in the art for more effecient and selective operation of commercial reforming units which take advantage of the properties of a particular catalyst.

SUMMARY OF THE INVENTION

In accordance with the present invention, there is provided a process for reforming a naphtha feedstream to obtain an improved $C_5$+ liquid yield, which process comprises conducting the the reforming in a series of reactors wherein:

(a) the lead reactor contains a catalyst comprised of about 0.1 to 1 wt. % Pt and about 0.01 to 0.1 wt. % Re, on an inorganic oxide support; and (b) the tail reactor contains a catalyst comprised of about 0.1 to 1 wt. % Pt, from about 0.1 wt. % to about 1.0 wt. % rhenium, based on the total weight of the catalyst (dry basis), uniformly dispersed throughout a particulate solid support.

In a preferred embodiment of the present invention the catalyst of the lead reactor contains from about 0.2 to 0.7 wt. % Pt and about 0.02 to 0.07 wt. % Re.

DETAILED DESCRIPTION OF THE INVENTION

As previously stated, the present invention relates to reforming naphtha feedstocks boiling in the gasoline range. Non-limiting examples of such feedstocks include a virgin naphtha, cracked naphtha, a naphtha from a coal liquefaction process, a Fischer-Tropsch naphtha, or the like. Typical feeds are those hydrocarbons containing from about 5 to about 12 carbon atoms, or more preferably from about 6 to about 9 carbon atoms. Naphthas, or petroleum fractions boiling within the range of from about 25° C. to about 230° C., and preferably from about 50° C. to about 190° C., contain hydrocarbons of carbon numbers within these ranges. Typical fractions thus usually contain from about 15 to about 80 vol. % paraffins, both normal and branched, which fall in the range of about $C_5$ to $C_{12}$, from about 10 to 80 vol. % of naphthenes falling within the range of from about $C_6$ to $C_{12}$, and from 5 through 20 vol. % of the desirable aromatics falling within the range of from about $C_6$ to $C_{12}$.

The reforming is conducted in a reforming process unit comprised of a plurality of serially connected reactors. For purposes of the present invention, it is important that the lead, or first, reactor contain a catalyst comprised of about 0.1 to 1 wt. % of Pt, preferably from about 0.2 to 0.7 wt. % Pt; and about 0.01 to 0.1 wt. % Re, preferably from about 0.02 to 0.07 wt. % Re, on an inorganic oxide support. The weight percents are based on the total weight of the catalyst (dry basis).

Reforming in the tail reactor is conducted in the presence of a catalyst comprised of about 0.1 to 1 wt. % Pt, preferably from about 0.2 to 0.7 wt. % Pt; about 0.1 to 1 wt. % Ir, preferably from about 0.1 to 1 wt. % Re; based on the total weight of the catalyst (dry basis). The metals of this catalyst will be substantially uniformly dispersed throughout the support.

The catalyst used in the present invention will preferably also contains halogen, preferably chlorine, in concentration ranging from about 0.1 percent to about 3 percent, preferably from about 0.8 to about 1.5 percent, based on the total weight of the catalyst. Preferably also, the catalyst is sulfided, e.g., by contact with a hydrogen sulfide-containing gas, and contains from about 0.01 percent to about 0.2 percent, more preferably from about 0.05 percent to about 0.15 percent sulfur, based on the total weight of the catalyst. The metal components, in the amounts stated, are uniformly dispersed throughout an inorganic oxide support, preferably an alumina support and more preferably a gamma alumina support.

The relative loadings of each catalyst should be such that they are sensitive to feed type and process conditions. The distribution of the catalyst types between lead and tail reactors may be varied as desired. In general, the catalyst in the tail reactors will account for about 20 to 90 wt. %, preferably from about 30 to 80 wt. %, and more preferably from about 50 to 70 wt. %, based on the total amount of catalyst charged to the reforming unit.

Practice of the present invention results in the suppression of excessive dealkylation reactions with simultaneous increase in dehydrocyclization reactions to increase $C_5$+ liquid yields, with only a modest activity debit vis-a-vis the use of a catalyst in the tail reactor which is otherwise similar but does not contain the tin, or contains tin in greater or lesser amounts than that prescribed for the tail reactor catalyst of this invention. In addition to the increased $C_5$+ liquid yields, temperature runaway rate during process upsets is tempered, and reduced; the amount of benzene produced in the reformate at similar octane levels is reduced, generally as much as about 10 percent to about 15 percent, based on the volume of the $C_5$+ liquids, and there is lower production of fuel gas, a product of relatively low value.

Practice of the present invention results in the suppression of excessive dealkylation reactions with simultaneous increase in dehydrocyclization reactions to increase $C_5$+ liquid yields. This is accomplished with only a tail reactor which is otherwise similar but dones ont contain the low levels of Re. In addition to the increased $C_5$+ liquid and hydrogen yields, temperature runaway rate during process upsets is tempered, and reduced. The amount of benzene produced in the reformate at similar octane levels is reduced, generally as much as about 10 percent to about 15 percent, based on the volume of the $C_5$+ liquids. There is also lower production of fuel gas, a product of relatively low value.

The catalyst employed in accordance with this invention is necessarily constituted of composite particles which contain, besides a support material, the hydrogenation-dehydrogenation components, a halide component and, preferably, the catalyst is sulfided. The support material is constituted of a porous, refractory inorganic oxide, particularly alumina. The support can contain, e.g., one or more alumina, bentonite, clay, diatomaceous earth, zeolite, silica, activated carbon, magnesia, zirconia, thoria, and the like; though the most preferred support is alumina to which, if desired, can be added a suitable amount of other refractory carrier materials such as silica, zirconia, magnesia, titania, etc., usually in a range of about 1 to 20 percent, based on the weight of the support. A preferred support for the practice of the present invention is one having a surface area of more than 50 $m^2/g$, preferably from about 100 to about 300 $m^2/g$, a bulk density of about 0.3 to 1.0 g/ml, preferably about 0.4 to 0.8 g/ml, an average pore volume of about 0.2 to 1.1 ml/g, preferably about 0.3 to 0.8 ml/g, and an average pore diameter of about 30 to 300 Angstrom units.

The metal hydrogenation-dehydrogenation components can be uniformly dispersed throughout the porous inorganic oxide support by various techniques known to the art such as ion-exchange, coprecipitation with the alumina in the sol or gel form, and the like. For example, the catalyst composite can be formed by adding together suitable reagents such as a salt of rhenium, and ammonium hydroxide or carbonate, and a salt of aluminum such as aluminum chloride or aluminum sulfate to form aluminum hydroxide. The aluminum hydroxide containing the rhenium salt can then be heated, dried, formed into pellets or extruded, and then calcined in air or nitrogen up to 540° C. The other metal components can then be added. Suitably, the metal components can be added to the catalyst by impregnation, typically via an "incipient wetness"0 technique which requires a minimum of solution so that the total solution is absorbed, initially or after some evaporation.

To enhance catalyst performance in reforming operations, it is also required to add a halogen component to the catalysts, fluorine and chlorine being preferred halogen components. The halogen is contained on the catalyst within the range of 0.1 to 3 wt. %, preferably within the range of about 0.8 to about 1.5 st. %, based on the weight of the catalyst. When using chlorine as the halogen component, it is added to the catalyst within the range of about 0.2 to 2 wt. %, preferably within the range of about 0.8 to 1.5 wt. %, based on the weight of the catalyst. The introduction of halogen into the catalyst can be carried out by any method at any time. It can be added to the catalyst during catalyst preparation, for example, prior to, following or simultaneously with the incorporation of a metal hydrogenation-dehydrogenation component, or components. It can also be introduced by contacting a carrier material in a vapor phase or liquid phase with a halogen compound such as hydrogen fluoride, hydrogen chloride, ammonium chloride, or the like.

The catalyst is dried by heating at a temperature above about 25° C., preferably between about 60° C. and 175° C., in the presence of nitrogen or oxygen, or both, in an air stream or under vacuum. The catalyst is calcined at a temperature between about 200° C. to 450° C., either in the presence of oxygen in an air stream or in the presence of an inert gas such as nitrogen.

Sulfur is a highly preferred component of the catalysts, the sulfur content of the catalyst generally ranging to about 0.2 percent, preferably from about 0.05 percent to about 0.15 percent, based on the weight of the catalyst (dry basis). The sulfur can be added to the catalyst by conventional methods, suitably by breakthrough sulfiding of a bed of the catalyst with a sulfur-containing gaseous stream, e.g., hydrogen sulfide in hydrogen, performed at temperatures ranging from about 175° C. to about 565° C., and at pressures ranging from about 1 to about 40 atmospheres for the time necessary to achieve breakthrough, or the desired sulfur level.

The reforming runs are initiated by adjusting the hydrogen and feed rates, and the temperature (Equivalent Isothermal Temperature) and pressure to operating conditions. The run is continued at optimum reforming conditions by adjustment of the major process variables, within the ranges described below:

| Major Operating Variables | Typical Process Conditions | Preferred Process Conditions |
|---|---|---|
| LEAD REACTOR CONDITIONS | | |
| Pressure, psig | 100–700 | 150–500 |
| Reactor Temp., °F. | 700–1000 | 800–950 |
| Recycle Gas Rate, SCF/B | 2000–10,000 | 2000–6000 |
| Feed Rate, W/Hr/W | 1–20 | 2–10 |
| TAIL REACTOR CONDITIONS | | |
| Pressure, psig | 100–700 | 150–500 |
| Reactor Temp., °F. | 800–1000 | 850–975 |
| Recycle Gas Rate, SCF/B | 2000–10,000 | 2000–6000 |
| Feed Rate, W/Hr/W | 1–10 | 2–8 |

The invention will be more fully understood by reference to the following comparative data illustrating its more salient features. All parts are given in terms of weight except as otherwise specified.

In conducting these tests, an n-heptane feed was used in certain instances. In others a full range naphtha was employed.

Inspections on the full range Arab Light Naphtha feed employed in making certain of the tests are given below.

| Property | Arab Light Naphtha |
|---|---|
| Gravity at 60° | |
| API° | 59.4 |
| Specific | 0.7412 |
| Octane, RON Clear | 38 |
| Molecular Weight | 111.3 |
| Sulfur, wppm | 0.3 |
| Distillation D-86, °F. | |
| IBP | 193.5 |
| 5% | 216.5 |
| 10% | 221.0 |
| 50% | 257.0 |
| 90% | 309.0 |
| 95% | 320.5 |
| FBP | 340.0 |
| Composition, Wt. % | |
| Total Paraffins | 65.1 |
| Total Naphthenes | 19.3 |
| Total Aromatics | 15.6 |

EXAMPLE 1

A conventional 0.3 wt. % Pt-0.3 wt. % Re catalyst was calcined in air at 500° C., reduced in hdyrogen at 500° C. for 17 hr., and sulfided to breakthrough at 500° C. with a hydrogen with a hydrogen/hydrogen sulfide blend. The catalyst was tested in heptane reforming, with the results appear in Table I below.

EXAMPLE 2

A 0.3 wt. % Pt, 0.05 wt. % Re catalyst was prepared by the following procedure. Alumina extrudates were suspended in water and carbon dioxide was bubbled through the mixture for 30 minutes. Solutions of chloroplatinic acid, perrhenic acid, and hydrochloric acid were added in the appropriate quantities, and the mixture was treated with carbon dioxide for 4 hours. The extrudates were dried, and the catalyst was calcined in air for 3 hours, reduced in flowing hydrogen for 17 hours, and sulfided with a hydrogen-hydrogen sulfide blend, all at 500° C. This catalyst was tested in heptane reforming and the results are shown in Table I below.

TABLE I n-Heptane, 500° C., 100 psig, 10 W/H/W, $H_2$/Oil-6

| Catalyst Yield, wt. % on feed | 0.3Pt–0.3Re | 0.3Pt–0.05Re |
|---|---|---|
| $C_1$ | 1.4 | 1.1 |
| i-$C_4$ | 3.8 | 2.7 |
| n-$C_4$ | 5.6 | 3.7 |
| $C_5$+ | 78.9 | 85.2 |
| Toluene | 28.5 | 30.1 |
| Conversion | 65.2 | 57.3 |
| Toluene Rate | 2.9 | 3.1 |
| Toluene Selectivity | 43.7 | 52.5 |

The above data show that the Pt-low concentration Re catalyst used in the lead reactor in the present invention is more selective than the conventional Pt-Re catalyst in terms of higher $C_5$+ liquid yield and toluene selectivity. The Pt-low concentration Re catalyst and the conventional Pt-Re catalyst are substantially at parity in terms of activity. The selectivity credits for the low Re catalyst used in the lead reactor are evident when the catalysts are tested on a full range naphtha at conditions simulating those in a commercial lead reactor. These data are presented in Table II below.

TABLE II

| Lead Reactor Reforming of Light Arab Paraffinic Naphtha at 500° C., 350 psig, 4500 SCF/B, 1.4 W/H/W | | |
|---|---|---|
| Catalyst | 0.3Pt–0.3Re | 0.3Pt–0.05Re |
| Octane | 96 | 96 |
| $C_5$+ LV% @ 100 RON | 62 | 70 |

The results demonstrate that at lead reactor conditions, the activities of the Pt-Re catalysts are susbstantially at parity. However, the selectivity advantage offerred by the Pt-low Re catalyst provides a substantial yield credit, and for this reason the Pt-low Re catalyst shows unexpected results over the conventional Pt-Re catalyst when used in the lead reactor.

EXAMPLE 3

The 0.3 wt. % Pt, 0.05 wt. % Re on alumina catalyst of Example 2 was staged with a 0.3 wt. % Pt, 0.3 wt. % Re on alumina catalyst in a single isothemal reactor. A naphtha feedstock was introduced into the reactor so that the low Re catalyst represented the first stage and the conventional 0.3 wt. % Re catalyst the second stage. The feedstock had a boiling range from about 90° C. to about 150° C. and was comprised of about 55.3 wt. % paraffins, 28.5 wt. % naphthenes, and 16.2 wt. % aromatics. Talbe III below gives the test conditions and the resulting hydrogen and $C_5$+ yields, and relative activity.

TABLE III

| 316 psig, 1.2 WHW, $H_2O$/Oil = 1.9 | | |
|---|---|---|
| Catalyst | 0.3Pt–0.3Re | 0.3Pt–0.05Re/0.3Pt–0.3Re |
| Yields @ 100 RONC | | |
| $H_2$ wt. % | 1.6 | 1.77 |
| $C_5$+, LV % | 70.9 | 73.00 |
| Relative Activity | 100 | 94 |

These results again demonstrate that at lead reactor conditions, the activities of the Pt-Re catalysts are substantially at parity. However, the selectivity advantage offered by the Pt-low Re catalyst provides a substantial $C_5$+ liquid and hydrogen yiels credit, and for this reason the Pt-low Re catalyst shows unexpected results over the conventional Pt-Re catalyst when used in the lead reactor.

What is claimed is:

1. A process for reforming a naphtha feedstream to obtain an improved $C_5$+ liquid yield, which process comprises conducting the reforming in a series of reactors wherein:

(a) the lead reactor contains a catalyst comprised of about 0.1 to 1 wt. % Pt and about 0.02 to 0.07 wt. % Re on an inorganic oxide support; and (b) the tail reactor contains a catalyst comprised of about 0.1 to 1 wt. % Pt, from about 0.1 wt. % to about 1 wt. % Re based on the total weight of the catalyst (dry basis), uniformly dispersed throughout a particulate solid support.

2. The process of claim 1 wherein the catalyst of the lead reactor contains from about 0.2 wt. % to 0.7 wt. % Pt.

3. The process of claim 1 wherein the catalyst of the tail reactor contains from about 0.2 wt. % to about 0.7 wt % Pt, and from about 0.2 wt. % to about 0.7 wt. % Re.

4. The process of claim 1 wherein each of the catalysts contains from about 0.1 to about 3 wt. % halogen.

5. The process of claim 1 wherein the catalyst contains from about 0.01 percent to about 0.2 percent sulfur.

6. The process of claim 1 wherein the inorganic oxide support component of the catalyst is alumina.

7. The process of claim 1 wherein the reforming conditions employed in the tail reactor of the series are defined as follows:

| | |
|---|---|
| Pressure, psig | about 100 to 700 |
| Reactor Temperature, °C. | about 425 to 565 |
| Gas Rate, SCF/B | about 2000 to 10,000 |
| Feed Rate, W/HR/W | about 1 to 10. |

8. The process of claim 7 wherein the reforming conditions employed in the tail reactor of the series are defined as follows:

| | |
|---|---|
| Pressure, psig | about 150 to 500 |
| Reactor Temperature, °C. | about 450 to 525 |
| Gas Rate, SCF/B | about 2000 to 6000 |
| Feed Rate, W/Hr/W | about 2 to 8. |

9. The process of claim 1 wherein the reforming conditions employed in the lead reactors of the series are defined as follows:

| | |
|---|---|
| Pressure, psig | about 100 to 700 |
| Reactor Temperature, °C. | about 370 to 540 |
| Gas Rate, SCF/B | about 2000 to 10,000 |
| Feed Rate, W/Hr/W | about 1 to 20. |

10. The process of claim 9 wherein the reforming conditions employed in the lead reactors of the series are defined as follows:

| | |
|---|---|
| Pressure, psig | about 150 to 500 |
| Reactor Temperature, °C. | about 425 to 510 |
| Gas Rate, SCF/B | about 2000 to 6000 |
| Feed Rate, W/Hr/W | about 2 to 10. |

* * * * *